United States Patent [19]

Kroger

[11] Patent Number: 4,974,494

[45] Date of Patent: Dec. 4, 1990

[54] KNOCKING DEVICE WITH AUTOCONTROL

[75] Inventor: Dietrich Kroger, Wiesbaden, Fed. Rep. of Germany

[73] Assignee: Netter GmbH, Fed. Rep. of Germany

[21] Appl. No.: 352,274

[22] Filed: May 16, 1989

[30] Foreign Application Priority Data

Jun. 4, 1988 [DE] Fed. Rep. of Germany ..... 3819112

[51] Int. Cl.[5] ..... F15B 11/10; E21C 9/00

[52] U.S. Cl. ..... 91/433; 173/17; 173/32

[58] Field of Search ..... 91/468, 433–442; 173/17, 32, 119

[56] References Cited

U.S. PATENT DOCUMENTS 3,193,025 7/1965 Reitzel ..... 173/119 X 3,610,349 10/1971 Dempsey ..... 173/32 X 4,333,537 6/1982 Harris ..... 173/17

*Primary Examiner*—William E. Wayner

*Attorney, Agent, or Firm*—Paul & Paul

[57] ABSTRACT

Described is a pneumatic knocking device for knocking dust off bunker walls, comprising a housing (1) which encloses an elongate spring chamber (13) with spring (9), having a vent bore (7), and which is closed at one end by a top wall (20) with hole (10), a valve wall (3) with connecting hole (8), a piston (2) which is movable towards the top wall (20) by means of compressed air against the pressure of the spring (9), and a quick-acting vent valve (**3, 8, 10, 11, 14*a*, 15) which is disposed in the region of the valve wall (3) and which vents the chamber (22) beneath the piston (2) into the spring chamber (13) by means of an air conduit (14**).

In accordance with the invention, for enlarging the control options insofar as automatic cyclic controls are improved, it is proposed that a control bore (17) is arranged in the side wall (**1*a*) of the housing in radially extending relationship in the third of the height (H) of the housing (1), which is at the mounting end, and is communicated by way of a control circuit (18) with a 3/2-way air valve (16) in the compressed air feed conduit (19) and that the 3/2-way air valve (16) is connected to the connecting hole (8) in the valve wall (3**).

3 Claims, 2 Drawing Sheets

KNOCKING DEVICE WITH AUTOCONTROL

Figure 1:
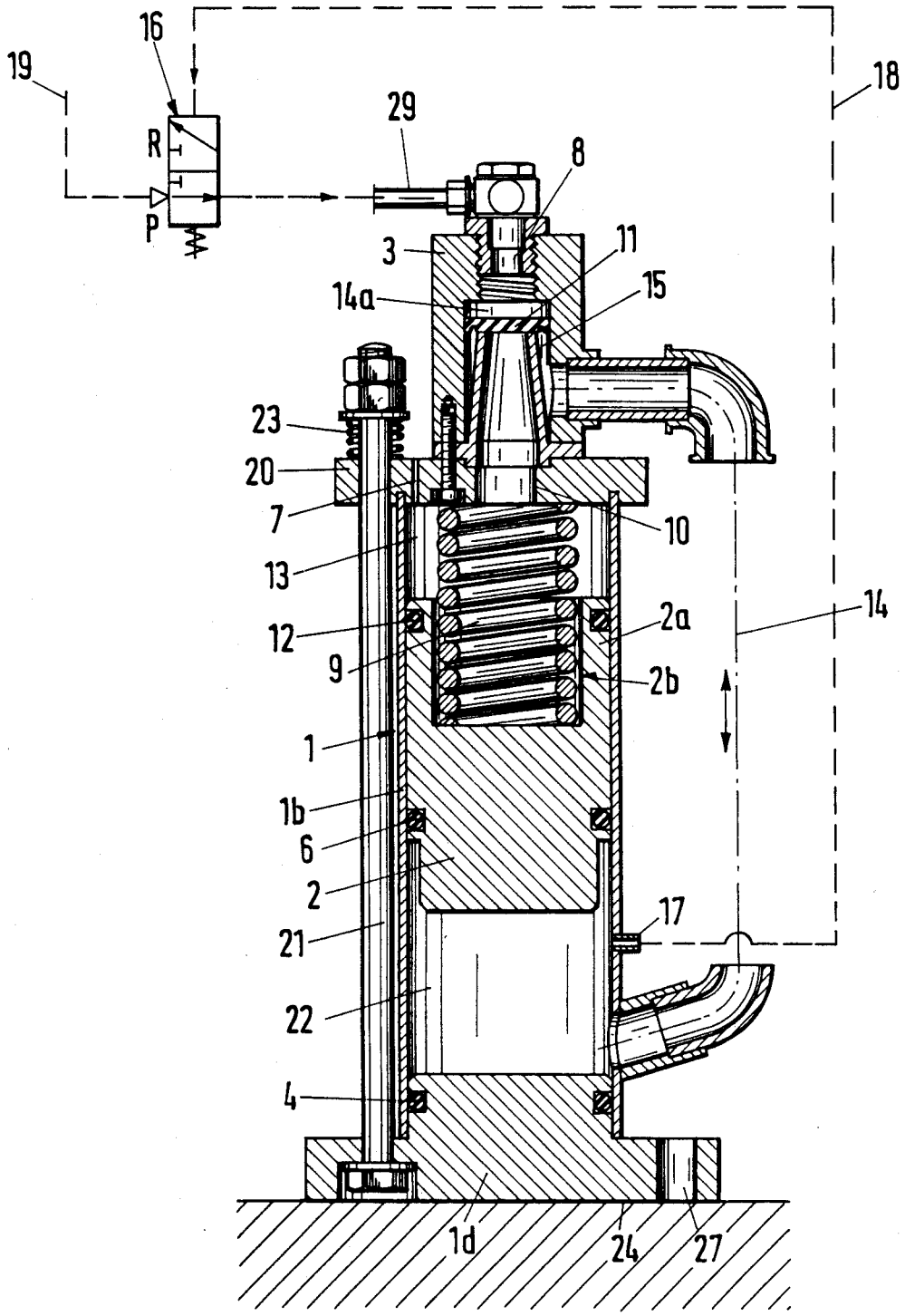

The invention relates to a pneumatically operable knocking device, in particular for knocking material in dust form off container walls, for example bunker walls, comprising a housing which encloses an elongate spring chamber having a vent bore, with spring, and which is closed at one end by a top wall with hole, a valve wall with connecting hole, a piston which is movable towards the top wall by means of compressed air against the pressure of the spring, and a quick-acting vent valve which is disposed in the region of the valve wall and which vents the chamber beneath the piston into the spring chamber by means of an air duct.

Pneumatic knocking devices of the above-indicated kind are used to remove materials in dust form from the walls of silos or other storage containers when the stored materials cling to the walls or have a tendency to form bridging configurations. A vigorous blow against the outside wall of the storage container can loosen the dust material, destroy the bridge and cause the material to flow out.

Compressed air interval knocking devices which are available on the market at the present time comprise a cylinder tube which is closed with a striker plate at its bottom end towards the container and with a cover at its top end and in which the striker plate and the cover are of larger diameter than the outside diameter of the tube and are provided at the periphery with four bores through which anchor screws are fitted. Screwed on the cover of the knocking device is a reversing valve to which the compressed air supply conduit goes on the input side and from which a connecting nipple is branched off, on the output side. A connecting nipple is also fitted into the tube above the striker plate and a hose connects the two connecting nipples together. Although control of the known knocking device could be automated to a certain extent, actuation thereof however is disadvantageously affected by means of a rod or a control pin on the piston, thereby requiring a complicated assembly and unreliable individual components. In addition it was not possible to control the striking interval or the spaces between respective blows or between respective groups of blows, using simple means, and not at all in spaces which were safeguarded in regard to explosion. The level of expenditure on the actuating means is particularly high if pneumatic control arrangements are used as generally two timing relays are required, for the loading time and for the interval time.

Knocking devices are already available on the market in which the device is actuated by an internal reversing control, namely by a needle valve which is incorporated in the device, by way of bored control conduits, in a complicated construction. Due to the vibration in performing a knocking operation, the needle valves easily go out of adjustment. Regulation or re-adjustment is very expensive as the knocking devices are often mounted at an inaccessible location in the case of a bunker. In addition there is the further disadvantage that it is not possible to provide for remote control, for example control in respect of the intervals, from a remote location.

The invention is therefore based on the problem of so improving a pneumatically operable knocking device of the kind set forth in the opening part of this specification that the control options can be enlarged, without adversely affecting the flow conditions, insofar as automatic cyclic control in respect of the blows produced by the piston is possible without mechanical components which co-operate with the piston.

In accordance with the invention that problem is solved in that a control bore is arranged in the side wall of the housing in radially extending relationship in the third of the height of the housing, which is at the mounting end, and is communicated by way of a control conduit with a 3/2-way air valve in the compressed air feed conduit and that the 3/2-way air valve is connected to the connecting hole in the valve wall.

When reference is made herein to air, compressed air, air valve or the like, the man skilled in the art will readily appreciate that other gases and in particular nitrogen or also fluids generally may obviously also be used in accordance with the invention.

It was explained in the opening part of this specification that the knocking devices according to the invention can be used to remove materials in dust form from walls and cause such materials to flow out. It will be appreciated that the knocking devices must therefore be mounted to the walls of the containers, in which respect, in accordance with the description set forth herein, the portion of the knocking device which is referred to as the 'lower' portion is mounted to the wall. The knocking device is generally of an elongate configuration so that, in accordance with the description set forth herein, the quick-acting vent valve is arranged 'upwardly' and the piston produces its blows against the underside, namely the bottom surface of the knocking device, which is arranged in opposite relationship to the quick-acting vent valve and which is mounted to the wall of the container. That underneath surface of the knocking device is referred to herein as the mounting end. If now the height of the housing is considered and divided into thirds, it will then be appreciated that the third of the height of the housing, which is towards the mounting end, is the lower region, more specifically the region with which the knocking device is mounted to the wall of the silo or the like.

In accordance with the teaching of the invention, a control bore is provided in the side wall of the housing, passing radially through same, in the said third of the height of the housing which is towards the mounting end.

It will be appreciated that the knocking device may be secured to the wall of a storage container in any position and the selected terms of 'up' or 'down' are not intended to limit either the arrangement or the position of the knocking device according to the invention.

The elongate chamber in which the piston is reciprocatable may admittedly be of polygonal, oval or polyhedral cross-section with rounded corners, but preferably the chamber in question is cylindrical for experience has shown that cylindrical pistons can be produced more easily. The above-mentioned spring chamber in which the compression or pressure spring is disposed is in the one and a half thirds of the piston chamber, which are towards the cover end, while in the lower third of that chamber in the housing is what is referred to as a 'chamber beneath the piston'. It will be appreciated in that connection that, upon actuation of the knocking device, the chamber beneath the piston can even be completely filled by the piston, in a specific embodiment.

The above-mentioned control bore in the side wall of the housing is therefore disposed in the lower region of the housing. In contrast to oscillating piston-type vibrators, the knocking device according to the invention produces individual knocking blows at adjustable intervals. Vigorous blows can advantageously be produced with a low level of consumption of air. When now the above-mentioned features are employed, the knocking device according to the invention permits simple remote control in a very inexpensive and operationally reliable fashion. More specifically, by virtue of the above-mentioned lower control bore in the housing of the knocking device, adjustment for triggering off a knocking blow can be effected when the piston is in a position just before the final position which is reached in the loading phase. In that case the control bore is free, beneath the piston and outside same, and the air pressure beneath the piston actuates the 3/2-way air valve so as to vent the connecting hole and thus trigger off the striking action of the knocking device.

The mere fact of providing that control bore provides, without linkage, without electrical drive means, fields or the like, that in accordance with the invention the device has an adjustment capability such that the device also operates at intervals. It is only necessary to cut off the supply of compressed air, by way of an inexpensive control arrangement which is possibly arranged at a remote location in the compressed air feed conduit, and the knocking device immediately stops operating.

It is also advantageous in accordance with the invention for a radially extending piston bore to be arranged in the side wall of the hollow portion of the piston. After a striking operation by the knocking device and in the final condition of the piston which is at the bottom in the device, the control bore in the lower region of the housing and the bore in the piston are disposed approximately at the same level. That facilitates a flow of air into the spring chamber. Although that also occurs when the upper hollow portion of the piston does not have a seal with a very good sealing effect, but for example only a guide ring, it will be seen that the throttle action as between the inside wall surface of the housing and the side wall of the hollow portion of the piston is circumvented if the bore in the piston is disposed in the side wall thereof.

The interval control arrangement, in accordance with the invention, can also be used inexpensively and without risk in areas which are safeguarded in respect of explosion. It is desirable for example for a throttle to be arranged in accordance with the invention in the compressed air feed conduit between the air supply connection and the 3/2-way air valve. As there are throttles which can be set very accurately and which are very inexpensive, the time for lifting the piston in the loading operation can also be really accurately set by regulating the throttle. The piston speed in the direction of the spring and thus the interval between knocking blows can therefore be regulated by means of the throttle. That installation is particularly advantageous if installed between the air supply connection and the throttle is a valve for the feed of compressed air in order to cause the striking intervals to be begun or concluded.

The above-described control arrangement is considerably improved in comparison with the known knocking devices. The novel mode of actuation, which can be achieved at low cost, is particularly of great advantage when only one actuating device is to be actuated at any one time.

When using the commercially available working time interval control configuration which actuates a valve disposed between the air supply connection and the throttle, the autocontrol function can also be used to cause the knocking device to strike a plurality of times during a time cycle which otherwise triggers off only one knocking blow. Very modest means are therefore adequate for that purpose while in the previously known knocking devices a very high level of expenditure was required to provide a control action of that kind.

The strength of the knocking blows can also be regulated by means of pressure regulators in the compressed air feed conduit.

The control arrangement according to the invention may be used in relation to various knocking device design configurations. There are for example knocking devices in which the housing comprises a cylinder tube which is closed with a striker plate at the bottom and a top wall at the top, with the quick-acting vent valve being screwed on the top wall at the top of the device. In such a knocking device, vent bores are arranged axially in the top wall because there is sufficient space at that location, beside the quick-acting vent valve disposed in the cover region.

In that construction with a striker plate arranged at the bottom of the device, an optimum striking action can be achieved, with the piston striking against the wall by way of the striker plate, like a steel hammer.

However it may be preferable from time to time to provide a sound damping effect in regard to the pneumatic knocking device, in which case, although the effect of the device is slightly weaker, the knocking blow is sound-damped as when using a rubber hammer. A second embodiment of that kind does not have the striker plate at the mounting end, but rather the housing is open at that end.

Figure 2:
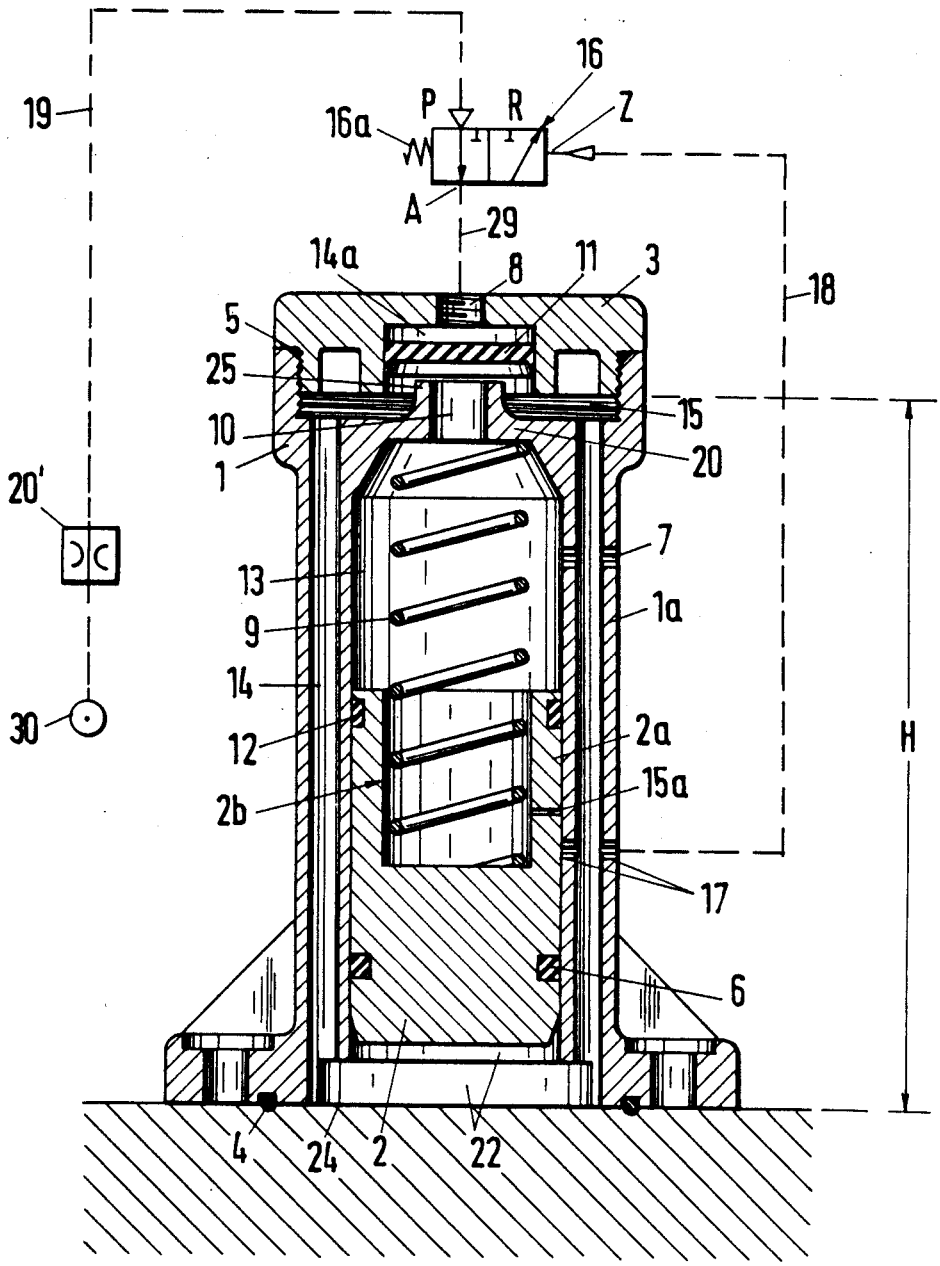

Further advantages, features and possible uses of the present invention will be apparent from the following description of preferred embodiments in conjunction with the drawings in which:

FIG. 1 is a view in vertical longitudinal section through a first embodiment of a knocking device with the control arrangement according to the invention, and FIG. 2 is a similar view to FIG. 1 but showing a second embodiment of a knocking device with integrated housing, but with the control arrangement being provided in the same manner.

The first embodiment of the invention as shown in FIG. 1 is a knocking device comprising a housing 1 with a cylinder tube **1*b* in which a piston 2 is movably mounted. In the rest position the piston 2 is urged upwardly in the direction indicated by the double-headed arrow, against the force of the spring 9, by compressed air which acts against the bottom of the piston and which passes into the chamber 22 beneath the piston 2, so that the side walls 2*a* of the hollow portion 2*b* of the piston 2 reduce the size of the spring chamber 13. The spring 9** is stressed by that configuration and the knocking device is 'loaded'.

The spring is mounted to the top wall 20 with hole 10, which is provided at the top with a sleeve-like valve wall 3 with a connecting hole 8. The quick-acting vent valve with control diaphragm 11 and valve chamber 15 is disposed in the wall 3. The feed of compressed air to the connecting hole 8 is by way of the conduit 29 providing the communication between the connecting hole 8 and a 3/2-way valve 16. In the position of the valve shown in the drawings, compressed air is supplied by way of the compressed air feed conduit 19.

Disposed at the end of the cylinder tube 1 which is in opposite relationship to the top wall 20 is the striker plate 1*d* which is fitted in the inside wall of the cylinder tube slidably within certain limits by means of the seal 4.

The top wall 20 and the striker plate 1*d* are held together by anchor screws 21. Disposed between the top wall and the nuts which are fitted on to the ends of the screws 21 are springs 23 which upon actuation of the device absorb the impact. The striker plate 1*d* is connected to the wall of the storage container or the like either directly or by way of a damping material. The openings 27 which are intended for the insertion of screws serve for fixing purposes. The space or chamber above the striker plate 1*d* or beneath the piston is identified by reference numeral 22 and communicates with the quick-acting vent valve in the wall 3 by way of a connection and a pipe 14.

Seals 6 are disposed on the piston at the bottom thereof, in radial relationship, while a guide member 12 is provided on the piston at the top thereof. The drawing also shows the vent bore 7 with which the spring chamber 13 communicates with the outside atmosphere.

As shown on the right-hand side in FIG. 1, arranged in the third of the height H of the housing 1, which is towards the mounting end is a control bore 17 which is communicated with the 3/2-way air valve 16 in the compressed air feed conduit 19 by way of a control conduit 18. In that arrangement the air valve 16 communicates with the connecting hole 8 in the wall 3 by way of the above-mentioned conduit 29.

In the other embodiment as shown in FIG. 2 the housing is constructed with integrated components and the knocking device illustrated therein also differs from the FIG. 1 embodiment in that the housing is open at the mounting end and the striker plate 1*d* is omitted.

The same components are again denoted by the same reference numerals. In both Figures the piston 2 is just in a condition shortly before it strikes against the mounting surface 24, at the lower end thereof, or strikes against the striker plate 1*d* (see FIG. 1), or after it has moved away from same again in the upward stroke movement.

The spring 9 is disposed in the hollow portion 2*b* of the piston 2 within the side walls 1*a* and bears against the solid portion of the piston 2 at one end while at the opposite end it bears against the top wall 20 of the housing in which there is a hole 10 which is surrounded upwardly by a cylindrical shoulder 25.

The substantially cylindrical side walls 1*a* of the housing 1 terminate as shown in FIG. 2 in an upward direction in a collar portion which is somewhat enlarged and which is provided with an internal screw&thread. The cover 3 is screwed into the screw thread, leaving a valve space or chamber 15. The cover may also be secured in position by radial screws.

The circular collar portion 26 is disposed in coaxial relationship with the further inwardly disposed shoulder 25 with the hole 10. Four air passages 14 which are for example uniformly spaced around the periphery of a circle open in the top wall 20, the passages 14 extending from the chamber 22 beneath the piston 2 almost over the entire height H of the housing 1, into the valve chamber 15. The housing is enlarged downwardly in a generally rectangular configuration and has four screw holes 27 by way of which the housing 1 can be screwed to a mounting surface 24 of a storage container, with the interposition of a seal 4.

A seal 5 is also provided at the cover end of the housing, while similarly a seal 6 is provided at the lower end of the piston 2, which is towards the open end of the housing, and a guide ring 12 is arranged in opposite relationship thereto at the hollow portion 2*b* of the piston 2, which is towards the cover.

The vent bores 7 are arranged in the upper third (towards the cover) of the height H of the housing 1, passing radially through the side wall 1*a*, in such a way as to provide a communication between the spring chamber 13 and, when the control diaphragm 11 is lifted off, also the air passages 14, and the outside air. In that arrangement the diameter of the vent bore is preferably considerably smaller than that of the air passages 14.

Disposed in the cover 3 in alignment with the hole 10 and in coaxial relationship is a valve bore which accommodates a control diaphragm 11 of rubber, plastics material or another elastomer, with the control diaphragm 11 being capable of sliding in an axial direction upwardly and downwardly. The control diaphragm 11 may be urged downwardly to such an extent that it bears against the annular end face of the shoulder 25 and seals off the hole 10 when a suitable pressure obtains. Provided centrally in the cover and coaxially with respect to the hole 10 and the valve bore is the connecting hole 8 to which the conduit 29 is connected in a manner which is only diagrammatically shown in the drawing. The conduit provides the communication between the connecting hole 8 and a 3/2-way valve 16. The valve 16 is in turn disposed in the conduit between the connecting hole 8 and the compressed air feed conduit 19. A throttle 20' and an air supply connection 30 are also disposed in the conduit 19, as shown in FIG. 2.

The control diaphragm 11 practically closes off the valve chamber 15 to a greater or lesser degree relative to the space or chamber 14*a* above the diaphragm 11. When there is a suitable pressure difference between the two chambers 14*a* and 15, air can flow past the edges of the control diaphragm 11. That is desirable, as will be described in relation to operation of the arrangement.

The drawings also show the valve spring 16*a* and the control bore 17 to which the control conduit 18 is connected for example by screw means.

In operation the knocking device operates in the following way, both in one embodiment and in the other (FIGS. 1 and 2).

Compressed air passes by way of the feed conduit 19 and the valve 16 through the connecting hole 8 to the flexible control diaphragm 11 which is thereby urged towards the hole 10 to the spring chamber 13 and is urged against the annular end face of the shoulder 25, closing off the spring chamber 13 relative to the valve chamber 15. As the spring chamber 13 communicates with the surrounding atmosphere or outside air by way of the vent bore 7, the pressure on the control diaphragm 11 from the actuating side thereof (from above) is greater than the pressure (from below) through the hole 10. The resulting pressure difference causes the diaphragm 11 to be pressed against the shoulder 25 and thus causes the hole 10 to be closed off. The incoming compressed air flows past the flexible outside edge of the control diaphragm 11, by way of the passages 14 which are provided in the housing 1 and which are for example formed by drilling or casting therein or which in the embodiment shown in FIG. 1 are flange-connected in the form of a hose, to beneath the piston 2 and presses same against the compression spring 9.

When the 3/2-way valve 16 which is used for actuating the knocking device is closed, that is to say it is displaced towards the left from the position shown in the drawings against the force of the spring 16*a*, the connecting hole 8 for the compressed air is vented. The chamber 14*a* above the control diaphragm 11 is now communicated with the outside air. As a result the pressure beneath the diaphragm 11 becomes stronger and lifts it. The compressed air beneath the piston 2 can now escape in a burst through the air passages 14 into the spring chamber 13 and from there into the outside air by way of the vent bore 7. The spring 9 can now shoot the piston 2 against the clamping or mounting surface 24. That causes shock acceleration of the mass, for example the wall, on which the knocking device is disposed.

The 3/2-way air valve 16 is disposed in the vicinity of or at any distance from the knocking device, between the conduits 29 and 19, in such a way that its air outlet A is connected to the connecting hole 8 for compressed air. The valve 16 is unactuated and open in the illustrated position, that is to say the air outlet A is connected to P, and the knocking device is loaded as soon as the air supply connection 30 can feed air.

The compressed air feed conduit 19 can be put under operating pressure by a control arrangement (not shown), for example by means of a globe valve which can be arranged between the air supply connection 30 and the adjustable throttle 20'.

Shortly before the piston 2 reaches its upper end position or its end position towards the cover, which it attains when the knocking device is loaded, the control bore 17 is then below the position that the seal 6 then attains. In that way a communication is provided by way of the control conduit 18 between the chamber 22 beneath the piston 2 and the control connection Z of the valve 16.

From the position shown in the drawings the valve 16 moves against the force of the spring 16*a* towards the left (FIG. 2) or downwardly (FIG. 1) so that the valve closes the conduit from P towards A and opens the communication from A towards R whereby the knocking device is actuated for the connecting hole 8 is in fact vented.

After a knocking blow has been produced, that is to say when the force in the spring 9 has moved the piston 2 downwardly, a piston bore 15*a* which in the embodiment shown in FIG. 2 is illustrated as extending radially through the side wall 2*a* of the hollow portion 2*b* of the piston 2 passes into the region of the control bore 17. In that way, the valve 16 can be vented by way of the control conduit 18, the spring chamber 13 and the vent bore 7. The spring 16*a* now returns the valve 16 to its illustrated position and the cycle can begin afresh.

The throttle 20' which is disposed in the compressed air feed conduit 19 between the air supply connection 30 and the valve 16 regulates the piston speed and therewith also the striking interval.

It will be appreciated that the control conduit 18 which is shown in diagrammatic form in FIG. 2 as extending outside the housing 1 may also be provided in the shell of the housing 1. In the FIG. 2 embodiment the quick-acting vent valve is integrated in the end of the housing 1 which is towards the cover while in the embodiment shown in FIG. 1 it is screwed on to the top wall 20.

The novel control arrangement means that the knocking device can be employed in particular uses. For example bakeries from time to time require knocking devices of smaller size, in regard to which it is also desired for the container to be almost completely emptied of material filling same, for example flour or baking powder, namely when another material is to be introduced into the container after it has been emptied. The knocking device can then be set in such a way that for emptying the remaining material from the container, it simultaneously knocks five times during the container emptying operation, with no further control arrangement than a throttle. The opening cylinder and the knocking device could be supplied by way of the same valve.

I claim:

1. A pneumatically operable knocking device, in particular for knocking material in dust form off container walls, for example bunker walls, comprising a housing (1) which encloses an elongate spring chamber (13) having a vent bore (7), with spring (9), and which is closed at one end by a top wall (20) with hole (10), a valve wall (3) with connecting hole (8), a piston (2) which is movable towards the top wall (20) by means of compressed air against the pressure of the spring (9), and a quick-acting vent valve (3, 8, 10, 11, 14*a*, 15) which is disposed in the region of the valve wall (3) and which vents the chamber (22) beneath the piston (2) into the spring chamber (13) by means of an air duct (14), characterized in that a control bore (17) is arranged in the side wall (1*a*) of the housing in radially extending relationship in the third of the height (H) of the housing (1), which is at the mounting end, and is communicated by way of a control conduit (18) with a 3/2-way air valve (16) in the compressed air feed conduit (19) and that the 3/2-way air valve (16) is connected to the connecting hole (8) in the valve wall (3).

2. A knocking device according to claim 1 characterized in that a radially extending piston bore (15*a*) is arranged in the side wall (2*a*) of the hollow portion (2*b*) of the piston (2).

3. A knocking device according to claim 1 or claim 2 characterized in that a throttle (20') is arranged in the compressed air feed conduit (19) between the air supply connection (30) and the 3/2-way air valve (16).

* * * * *